US006530854B2

(12) United States Patent
Sakuma et al.

(10) Patent No.: US 6,530,854 B2
(45) Date of Patent: Mar. 11, 2003

(54) BELT FOR SHOE PRESS

(75) Inventors: Norio Sakuma, Tanashi (JP); Kiyoshi Koase, Chiba (JP)

(73) Assignee: Ichikawa Co., Ltd., Tokyo (JP)

( * ) Notice: Subject to any disclaimer, the term of this patent is extended or adjusted under 35 U.S.C. 154(b) by 29 days.

(21) Appl. No.: 09/791,102

(22) Filed: Feb. 23, 2001

(65) Prior Publication Data

US 2001/0021437 A1 Sep. 13, 2001

(30) Foreign Application Priority Data

Mar. 13, 2000 (JP) ..... 2000-069532

(51) Int. Cl.[7] ..... F16G 1/00; F16G 5/00; F16G 9/00

(52) U.S. Cl. ..... 474/237; 474/260; 474/263

(58) Field of Search ..... 474/260, 263, 474/237

(56) References Cited

U.S. PATENT DOCUMENTS

| | | | | | |
|---|---|---|---|---|---|
| 3,834,853 | A | * | 9/1974 | Bequet et al. | 425/336 |
| 4,042,009 | A | * | 8/1977 | Horstmann et al. | 164/433 |
| 5,073,379 | A | * | 12/1991 | Klimesch et al. | 424/467 |
| 5,417,619 | A | * | 5/1995 | Tajima et al. | 474/260 |
| 5,918,099 | A | * | 6/1999 | Schlueter, Jr. et al. | 399/333 |

FOREIGN PATENT DOCUMENTS

| | | |
|---|---|---|
| JP | 6-33590 | 5/1994 |
| JP | 6-63195 | 8/1994 |
| JP | 8-2590170 | 12/1996 |
| JP | 10-2832713 | 10/1998 |
| JP | 11-500793 | 1/1999 |

* cited by examiner

*Primary Examiner*—David A. Bucci
*Assistant Examiner*—Justin Stefanon
(74) *Attorney, Agent, or Firm*—Howson & Howson

(57) ABSTRACT

A shoe press belt for papermaking is composed of heat-resistant base and resin layers, the resin layer containing a filler for either increasing or decreasing its thermal conductivity. The resin layers do not soften at high temperatures, and consequently the dewatering grooves do not deform during the pressing operation. Improved performance is observed both with both types of fillers. In one case external heat is prevented from entering the belt, and in the other case, the resin layers of the belt are not adversely affected by external heat even when they permit entry of heat. The resin layer may be composed of sublayers, some having filler, with the outer layer preferably free of filler so that the surface characteristics of the belt are unaffected. The sublayers may have fillers with different thermal conductivities, proceeding progressively from low to high or from high to low, for improved control over belt temperature.

1 Claim, 4 Drawing Sheets

FIG. 5

| Material | Thermal conductivity | Material | Thermal conductiv-ity | Material | Thermal conductivity |
|---|---|---|---|---|---|
| Nylon-6 | 0.23 | Phenolic resin | 0.36 | SUS 816 | 16.1 |
| Nylon-66 | 0.23~0.29 | Melamine resin | 0.29~0.42 | SUS 480 | 26.1 |
| PET | 0.27 | Polyamideimide | 0.39~0.77 | Al (99%) | 226 |
| PPS | 0.29~0.33 | Thermoplastic polyimide | 0.16 | Al | 238 |
| PEEK | 0.25 | Polyether imide | 0.22 | Glass balloon | 0.14 |
| PTFE | 0.20~0.25 | Cornex | 0.15 | Fluoroplastic | 0.25 |
| PS | 0.13 | Nomex | 0.13 | Air | 0.0236 |
| PEF | 0.18~0.22 | Glass | 1.04 | Microcap-sules | 0.03 |
| Polyimide | 0.16 | Carbon | 11.7 | | |

(Thermal conductivity: W/m·K)

FIG. 6

| | Belt temperature | | Retention of volume of grooves | Lubricant temperature | | Film effect | | Driving load | |
|---|---|---|---|---|---|---|---|---|---|
| | Without shower | With shower | | Without shower | With shower | Without shower | With shower | Without shower | With shower |
| Example 1 (Sample 101) | Below 70°C | Not used | 95% | Below 70°C | Not used | Good | Not used | Unchanged | Not used |
| Example 2 (Sample 102) | Above 70°C | Below 70°C | 90% | Above 70°C | Below 70°C | Slightly decreased | Good | Slightly increased | Unchanged |
| Example 3 (Sample 103) | Above 70°C | Below 70°C | 90% | Above 70°C | Below 70°C | Slightly decreased | Good | Slightly increased | Unchanged |
| Comparative Example 1 (Sample 104) | Above 80°C | Above 75°C | 60% | Above 80°C | Above 75°C | Decreased | Decreased | Increased | Increased |
| Comparative Example 2 (Sample 105) | Above 75°C | Above 75°C | 70% | Above 75°C | Above 75°C | Decreased | Decreased | Increased | Increased |

BELT FOR SHOE PRESS

BACKGROUND OF THE INVENTION

This invention relates to papermaking and more particularly to improvements in a belt for a shoe press, the belt being designed to be introduced into the high-temperature nip of a papermaking machine to effectively squeeze water out of the wet web in the press section of the machine.

For high temperature papermaking technology, a technique known as impulse drying has recently been proposed, wherein water is squeezed out of a fibrous web by pressing the web by means of a shoe press at a high temperature, typically 200° C. or greater, and ranging even up to 350° C. By this process, dewatering is accomplished not only by squeezing water out of the fibrous web under pressure applied by the press, but also by evaporation of water from inside the fibrous web as a result of heating. The web is exposed to a high temperature over the relatively long duration of its passage through the press part of the machine.

Although we do not wish to be bound by any particular theory, we believe that the heating of the fibrous web may cause the water contained in the web to decrease in viscosity, and thereby permit more efficient squeezing than achieved at conventional press temperatures. High temperature, impulse drying technology is discussed in Japanese Patent Publications 63195/1994 and 33590/1994, in Japanese Patents 2590170 and 2832713, and in Published International application WO97/15718 (laid-open in Japan under PCT Application number 500793/1999).

Japanese Patent Publication 33590/1994 is concerned particularly with a belt which has grooves in its surface to ensure efficient squeezing of water while preventing paper breakage and poor formation, the breakage being due to the removal of a large amount of water from the fibrous web during pressing at high temperature and high pressure.

A problem presented by the technology briefly described above is that the belt is constructed of a resin layer which is subject to softening when exposed to high temperature and high pressure. The softened resin layer tends to deform, clogging the grooves and thereby reducing the amount of water removed. Moreover, the softened resin layer wears readily, thereby both decreasing the volume of the grooves and shortening the service life of the belt.

In addition, when the belt is operated at high temperature, its durability is impaired by thermal degradation of its constituents, i.e., both the supporting fabric and the resin. The degradation of the supporting fabric leads to dimensional instability, and the degradation of the resin leads to cracking of the belt.

Another problem encountered in the use of a shoe press belt at high temperature is that the lubricant used to reduce friction between the belt and the shoe decreases in viscosity with increasing belt temperature. The decrease in viscosity of the lubricant results in an increase in the driving load on the papermaking machine.

SUMMARY OF THE INVENTION

We have undertaken intensive investigations of the aforementioned problems with the objective of providing a shoe press belt so constructed as to isolate or protect its resin layer from external heat so that the resin layer does not soften and its grooves do not deform during operation at high temperature and high pressure.

The improved shoe press belt in accordance with our invention consists of a base layer and a resin layer, the resin layer having a surface facing the base layer and an opposite surface with a groove for promoting dewatering. The shoe press belt is characterized by the fact that both the base layer and the resin layer are made from a heat-resistant material and the resin layer contains a filler to control its thermal conductivity. Thus, the belt is constructed in such a way that both the base layer and the resin layer have improved heat resistance, and the belt is less subject to the effects of external heat.

In accordance with one embodiment of the invention, the filler is composed of a material having a thermal conductivity lower than that of the material of the resin layer, to prevent the temperature of the resin layer from increasing excessively due to external heat.

In accordance with another embodiment of the invention, the filler is composed of a material having a thermal conductivity higher than that of the material of the resin layer, so that the resin layer more effectively expels heat which enters the resin layer from outside, thereby cooling itself more rapidly.

In accordance with still another embodiment of the invention, the resin layer is composed of a plurality of sublayers placed one over another, and at least one, but preferably not all, of said sublayers contains the filler. Constructed in this way, the belt can have its thermal conductivity properly controlled without affecting the performance of the resin at the surface.

In still another embodiment in which the resin layer is composed of a plurality of sublayers placed over one another, each of at least two sublayers contains a filler, and the thermal conductivity of each sublayer containing a filler differs from the thermal conductivity of each of the other sublayers. Each of the sublayers may contain a filler, or, alternatively, some, but not all, of the sublayers may contain a filler. The thermal conductivity of the several layers may be controlled by utilizing fillers having different thermal conductivities, or alternatively, by incorporating different concentrations of filler in the different layers. In this embodiment, the belt can have a changing thermal conductivity throughout the thickness of its resin layer, either from low to high, or from high to low, for efficient heat control. With a sufficient number of layers, the change in thermal conductivity can be made effectively continuous.

As will be apparent from the following description, advantage can be taken of various combinations of the above-described features to achieve control of heat and to prevent the adverse effects of excessive heat in a shoe press belt operated at high temperature and high pressure.

Further objects, details and advantages of the invention will be apparent from the following detailed description, when read in conjunction with the drawings.

BRIEF DESCRIPTION OF THE DRAWINGS

FIG. 5 is a table showing the thermal conductivity (W/m° K) of various materials; and FIG. 6 is a table showing the results of tests of the physical properties of belt samples in accordance with the invention and comparative examples, carried out using the shoe press tester of FIG. 4 over an interval of 100 hours.

DETAILED DESCRIPTION OF THE PREFERRED EMBODIMENT

Figure 1:
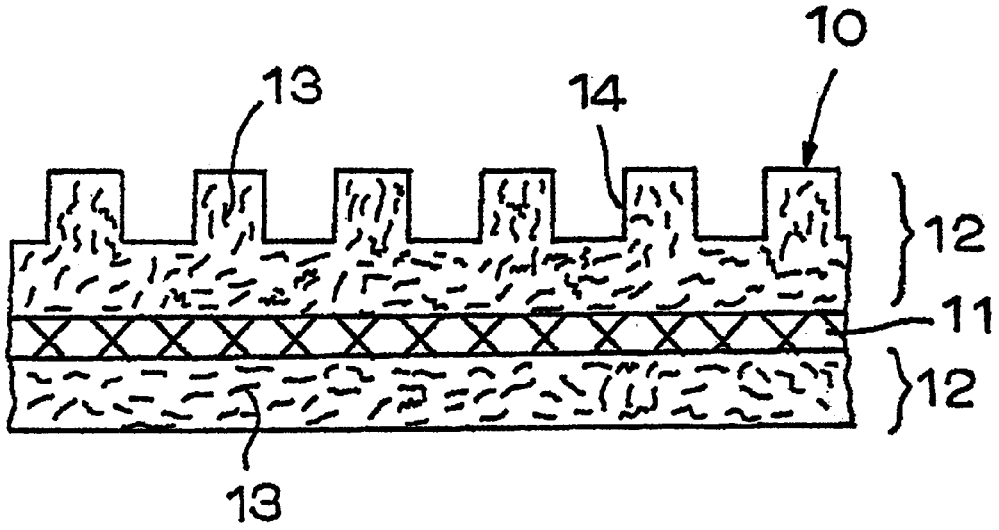
FIG. 1 is an enlarged, schematic sectional view showing a belt in accordance with the invention, having a resin layer containing a filler.
Figure 2:
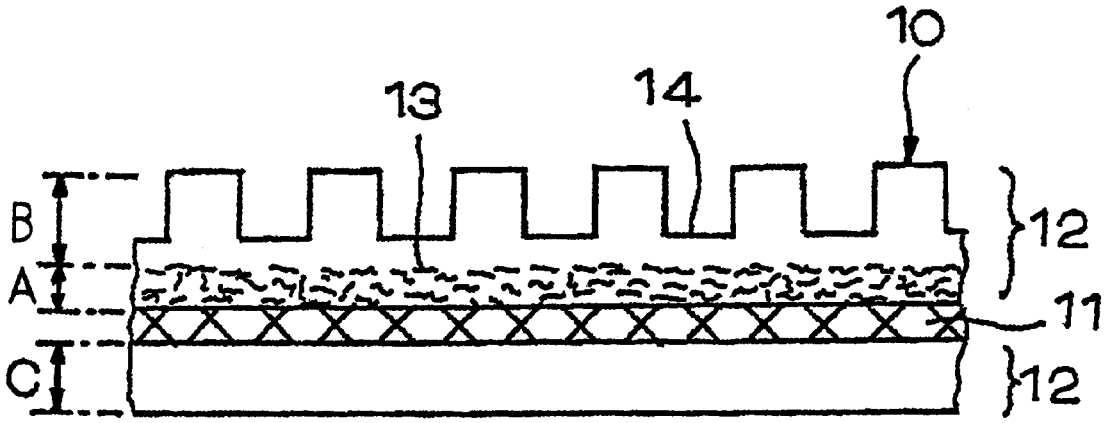
FIG. 2 is an enlarged, schematic sectional view showing another belt in accordance with the invention, in which the resin layer comprises a plurality of sublayers, some of which contain a filler.
Figure 3:
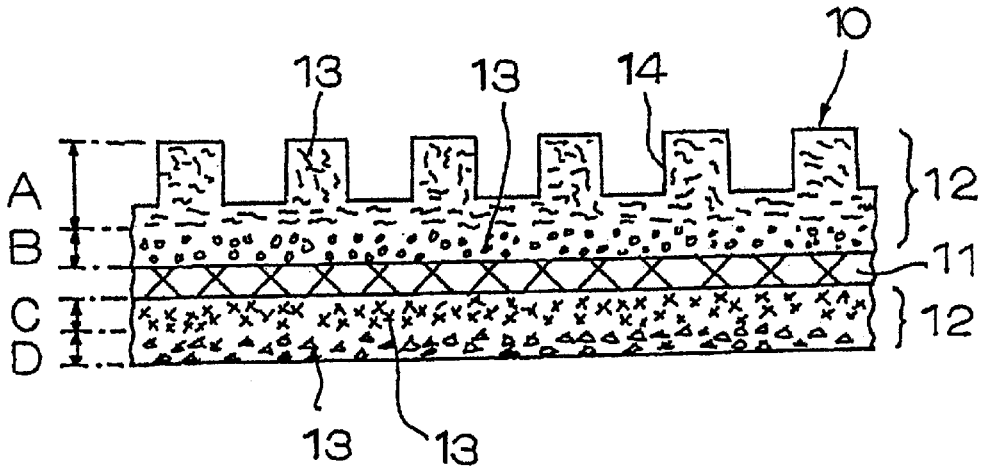
FIG. 3 is an enlarged, schematic sectional view showing still another belt in accordance with the invention, in which the resin layer comprises a plurality of sublayers each of which contains a filler, and in which the thermal conductivity of the filler changes stepwise from one sublayer to another across the thickness of the belt.

Each of the belts 10 of FIGS. 1–3 comprises a base layer 11 and a resin layer 12 (which will ordinarily be on both sides of the base layer). Both the base layer and the resin layer are made from a highly heat-resistant material. Thus, the resin layers 12, per se, have improved durability at high temperatures.

Examples of suitable highly heat-resistant materials for the resin layer are fluoroplastics such as polytetrafluoroethylene (PTFE), tetrafluoroethylene/hexafluoropropylene copolymer (FEP), and ethylene/tetrafluorethylene copolymer (ETFE); aromatic and heterocyclic resins such as polyether-ether ketone (PEEK), polyether sulfone, and polyether imide; and heat-resistant rubber such as acrylic rubber (ACM), ethylene acrylic rubber (EAR), ethylene-propylene diene rubber (EPDE), fluororubber, silicone rubber, chlorinated polyethylene rubber (CM), chlorosulfonated polyethylene rubber (CSM) and butyl rubber (IIR). For the purpose of this description, the term "resin" should be understood as including rubbers.

Examples of highly heat-resistant materials for the base layer are organic fibers such as those based on PTFE, FEP, ETFE, PEEK, PES, PEI, para-aramide and meta-aramide; inorganic fibers such as glass fiber and rock wool; and metal fibers such as those based on steel, stainless steel and bronze. These materials for the base layer may be used in the form of yarn (such as monofilament, multifilament and spun yarn) woven fabric, non-woven fabric and cross-laid, non-woven fabric).

In each of the embodiments of FIGS. 1, 2 and 3, the resin layer 12 contains a filler 13 to control the belt temperature.

The embodiment of FIG. 1 is formed by coating both sides of the base layer 11 with a resin material containing a filler 13, heat-curing the resin material, thereby forming the resin layer 12, grinding the resin layer until a design thickness is obtained, and finally cutting dewatering grooves 14 in one of the outwardly facing surfaces of the resin layer (the upper layer in FIG. 1).

The embodiment of FIG. 2 is characterized in that the resin layer 12 consists of three sublayers: a first sublayer A in contact with the upper surface of the base layer 11, a second sublayer B covering the upper surface of the first sublayer A, and a third sublayer C in contact with the lower surface of the base layer 11. The first sublayer A is formed by coating the base layer with a resin material containing a filler 13, and then heat-curing the resin. The second sublayer B and the third sublayer C are then formed from a filler-free resin material and heat-cured. The upper and lower surfaces of the outer resin sublayers B and C are ground to the design thickness. Finally, dewatering grooves 14 are cut in the outer surface of resin sublayer B. The belt 10 as a whole has a controlled thermal conductivity, but its surface characteristics are unaffected by the presence of the filler 13.

In the embodiment of FIG. 3, the resin layer 12 consists of four sublayers A, B, C and D (from top to bottom), each of which contains a filler 13. The identity of the fillers in the successive layers, or the amount of filler in the successive layers, or both, vary from layer to layer so that the thermal conductivity of the resin layer 12 progressively changes across the thickness of the belt. The sublayers are formed, as in the case of FIG. 2, by successive coating steps, each followed by heat-curing. Again, as in the case of FIG. 2, the upper and lower surfaces of the resin layer 12 are ground to achieve the design thickness, and finally dewatering grooves 14 are cut in the upper surface. The belt thus obtained varies in thermal conductivity across its thickness from high to low, or from low to high, as desired.

The filler 13 contained in the resin layer 12 in each of the belts described above is intended to control the belt temperature in either of two ways. It may resist temperature rise in the belt, or prevent excessive heat accumulation in the belt.

In order to resist temperature rise in the belt it is necessary to use a filler having a thermal conductivity lower than that of the resin material used to form the resin layer 12. Bubbles, for example, can serve as a suitable filler for this purpose, as they exhibit a low thermal conductivity. When the filler consists of bubbles in the resin layer, the bubbles protect the resin layer from thermal degradation and prevent the lubricant temperature from rising excessively.

In order to prevent heat accumulation in the belt, it is necessary to use a filler having a thermal conductivity higher than that of the resin material used to form the resin layer 12. By using a filler having a higher thermal conductivity, it is possible to enhance the cooling effect of a coolant such as water, thereby preventing excessive heat accumulation in the belt and also preventing excessive rise in the temperature of the lubricant.

The raw materials of the base layer 11, the resin layer 12 and the filler 13 may be selected on the basis of thermal conductivity (W/m° K) shown in FIG. 5. The raw material for each component can consist of a combination or mixture of materials so long as they have no adverse effect on strength and durability.

EXAMPLE 1

A sample of the belt 101 in accordance with the invention was prepared, the sample having a structure corresponding to FIG. 1. It was composed of a base layer 11 and a resin layer 12 covering both sides of the base layer. The base layer 11 was a non-woven fabric of heat resistant NOMEX fiber, a nylon fiber specially fabricated to withstand high temperatures. (The NOMEX fiber had a thermal conductivity H=0.13 W/m° K.) The resin layer 12 was formed by coating with a heat-resistant fluoroplastic (H=0.25) filled with chopped NOMEX fiber (H=0.13). Coating was followed by heat curing. The coated layer was ground until a desired thickness was obtained. Finally, dewatering grooves were cut in the front side of the resin layer.

Figure 4:
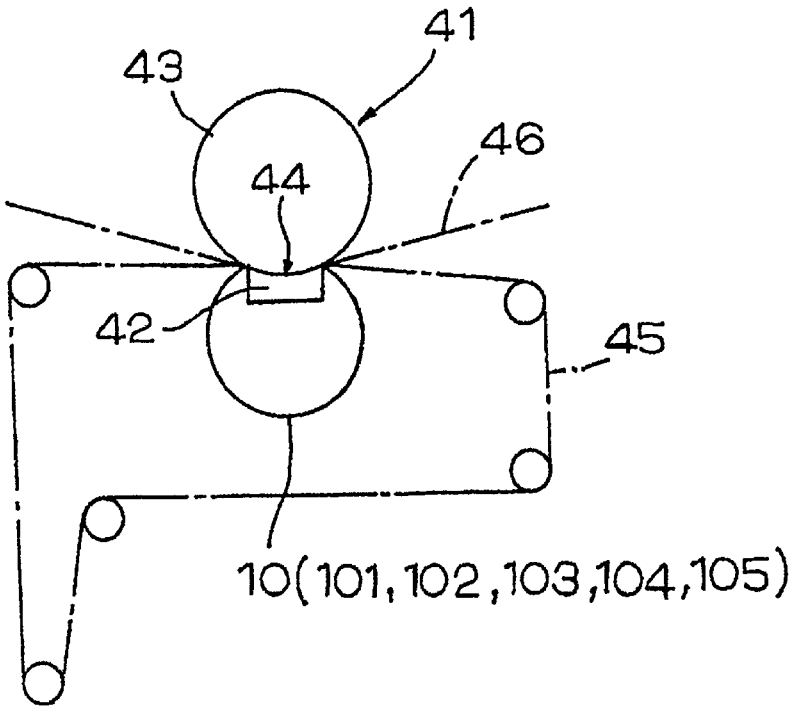
FIG. 4 is a schematic diagram showing a tester for a shoe press.

The belt 101, prepared as described above, was tested using the shoe press tester 41 of FIG. 4, which consists of a pressing shoe 42, a heating roll 43, and a press region 44. The belt 101, in endless form, was passed between the pressing shoe 42 and the heating roll 43 for 100 hours at a speed of 1000 m/min and a nip pressure of 1000 kg/cm, with the heating roll 43 kept at 200° C. (In the case of an actual machine, an endless felt 45 and a wet web 46, both indicated by broken lines, are also run between the heating roll and the belt 101.) After test runs, the physical properties of the belt were measured.

According to the results of the test runs (shown in FIG. 6), because of its low thermal conductivity, the belt temperature remained below 70° C., with very little temperature rise despite instantaneous heating under pressure. The low belt temperature also maintained a low temperature in a lubricant injected between the pressing shoe 42 and the belt 101. As a result, the dewatering grooves wore only 5% or so, and the lubricant film remained effective, no increase in the driving load being observed.

EXAMPLE 2

A sample of the belt 102 in accordance with the invention was prepared, the sample having a structure corresponding to FIG. 2. The belt was composed of a base layer 11, and a resin layer 12 covering both sides of the base layer. The base layer 11 was a cross-laid, non-woven fabric of highly heat-conducting carbon fiber (H=11.7). A first resin layer was formed on one side of the base layer 11 by coating with a heat-resistant fluoroplastic (the same one as used in Example 1) filled with chopped carbon fiber (H=11.7), produced from the same carbon fiber used for the base layer 11. The first resin layer and the back of the base layer were coated with an unfilled fluoroplastic. Coating was followed by heat curing. The coated layer was ground, and finally, dewatering grooves were cut in the front side of the resin layer.

The belt 102, prepared as described above, was tested by using the shoe press tester 41 (FIG. 4) in the same manner as in Example 1. After test runs for 100 hours, the physical properties of the belt were measured. The results are shown in FIG. 6. The belt temperature exceeded 70° C., but it easily decreased below 70° C. upon cooling with a water shower. The lubricant temperature also remained low. The lubricant film remained effective, no increase in the driving load being observed. The dewatering grooves retained 90% of their original volume after the test.

EXAMPLE 3

A sample of the belt 103 in accordance with the invention was prepared, the sample having a structure corresponding to FIG. 3. The belt was composed of a base layer 11, and a resin layer 12 covering both sides of the base layer. The base layer was a woven fabric of polyester fiber (H=0.27). The front outer resin layer A was formed from a urethane resin (H=0.27), filled with alumina powder (H=226). The intermediate resin layer B was formed from a urethane resin filled with chopped carbon fiber (H=11.7). The back outer resin layer D was formed from a urethane resin (H=0.27) filled with chopped NOMEX fiber (H=0.13). The second intermediate resin layer C was formed from a urethane resin (H=0.27) filled with microcapsules (H=0.03). These four resin layers differ in thermal conductivity. After heat curing, the front and back outer layers were ground, and finally, the dewatering grooves 14 were cut in the front side of resin layer A.

The belt 103, prepared as described above, was tested by using the shoe press tester 41 (FIG. 4) in the same manner as in Examples 1 and 2. After test runs for 100 hours, the physical properties of the belt were measured. The results are shown in FIG. 6. It was possible to prevent heat accumulation in the surface layer by a water shower. Owing to the non-heat conducting back layer, the belt temperature and lubricant temperature did not exceed 70° C. The lubricant film remained effective, there being no observed increase in the driving load. The dewatering grooves 14 retained 90% of their original volume following the test.

The embodiments of the invention are not limited to the above three examples. They may be modified to control thermal conductivity. Other examples of fillers that can be used include air-containing hollow fillers such as glass balloons and microcapsules.

COMPARATIVE EXAMPLE 1

A belt 104 was prepared as a comparative example. This belt was composed of a base layer 11 and a resin layer 12 covering both sides thereof. The base layer 11 was a woven fabric of polyester fiber (H=0.27). The resin layer 12 was formed by coating with a urethane resin (H=0.27) in general use. Coating was followed by heat curing and surface grinding. Finally, dewatering grooves were cut in the front side of the resin layer.

The comparative belt 104, prepared as described above, was tested by using the shoe press tester 41 (FIG. 4) in the same manner as in Examples 1, 2 and 3. After test runs for 100 hours, the physical properties of the belt were measured. The results are shown in FIG. 6. The surface temperature of the belt 104 exceeded 70° C., which is the maximum allowable temperature for urethane resin. This high temperature accelerated the wear of the resin, and consequently the dewatering grooves retained only 60% of their volumes following the test. The lubricant temperature also exceeded 75° C. The film effect was poor and the driving load increased. Water showering decreased both the belt temperature and the lubricant temperature, but the belt temperature did not decrease below the maximum allowable temperature of 70° C.

COMPARATIVE EXAMPLE 2

A belt 105 was prepared as a second comparative example. This belt was composed of a base layer 11 and a resin layer 12 covering both sides thereof. The base layer 11 was a non-woven fabric of NOMEX fiber (H=0.27). The resin layer 12 was formed by coating with a urethane resin (H=0.27) in general use. Coating was followed by heat curing and surface grinding. Finally, dewatering grooves were cut in the front side of the resin layer.

The comparative belt 105, prepared as described above, was tested by using the shoe press tester 41 (FIG. 4) in the same manner as in Examples 1, 2 and 3. After test runs for 100 hours, the physical properties of the belt were measured. The results are shown in FIG. 6. The surface temperature of the belt 105 exceeded 75° C., which is the maximum allowable temperature for urethane resin. This high temperature accelerated the wear of the resin, and consequently the dewatering grooves retained only 70% of their volume following the test. The lubricant temperature also exceeded 75° C. The film effect was poor and the driving load increased. Water showering decreased both the belt temperature and the lubricant temperature, but neither the belt temperature nor the lubricant temperature decreased below 70° C., which is the maximum allowable temperature for the belt.

It is apparent from FIG. 6 that it is possible to decrease the thermal conductivity of the belt, to reduce the amount of external heat entering the belt, and to prevent the belt temperature from increasing, if both the base layer 11 and the resin layer are made from highly heat-resistant materials and the resin layer is mixed with a filler 13 which has a thermal conductivity lower than that of its raw material. The same effect can be produced if the resin layer is mixed with a substance which has a higher thermal conductivity than the raw material of the resin layer. The resulting belt has a high thermal conductivity, and, upon cooling, readily discharges heat which has entered the belt from the outside. In either case, the durability of the belt is improved.

In summary, in each embodiment of the invention, the belt comprises a base layer and a resin layer, the latter having surface grooves to promote dewatering. Both the base layer and the resin layer are made from a heat resistant material, and the resin layer contains a filler to control the thermal conductivity of the belt.

According to a first aspect of the invention both the base layer and the resin layer having high heat resistance. Owing to the filler contained therein, the belt permits only a small amount of heat to enter from the outside, or is less vulnerable to heat even if heat enters from the outside. Thus, the lubricant is subjected to less heat, maintains adequate viscosity, and produces its film effect, so that the driving load of the machine does not increase, and a saving in the cost of energy is realized.

According to a second aspect of the invention, the filler is composed of a material having a thermal conductivity lower than that of the material of the resin layer. The low thermal conductivity, imparted to the resin layer as a result of the presence of the filler, prevents the temperature of the belt from increasing significantly even though heat enters the resin layer from the outside.

According to a third aspect of the invention, the filler is composed of a material having a thermal conductivity higher than that of the material of the resin layer. The high thermal conductivity imparted to the resin layer as a result of the presence of the thermally conductive filler permits the belt to discharge heat easily when heat enters the belt from the outside. Thus, the belt rapidly cools itself and accumulation of heat in the belt is prevented.

In accordance with a fourth aspect of the invention, the resin layer is composed of a plurality of sublayers placed one over another, with each sublayer selectively a filler altering its thermal conductivity. That is, at least one, but preferably not all, of the sublayers contains a filler. If the uppermost resin sublayer contains no filler and the other resin sublayers contain filler, it is possible to control the thermal conductivity of the belt as a whole without altering the performance of the resin at the surface of the belt, i.e. at the felt-contacting surface.

In accordance with a fifth aspect of the invention, the resin layer is composed of a plurality of sublayers placed one over another, with each of several sublayers containing a filler. The thermal conductivity of each sublayer containing a filler differs from the thermal conductivity of each of the other sublayers. If the layers are arranged so that their thermal conductivities proceed progressively from high to low or from low to high, it is possible to control belt temperature effectively.

We claim:

1. A belt for a shoe press, said belt consisting of a base layer and a resin layer, the resin layer covering both sides of the base layer and being composed of a first part on one side of the base layer and a second part on the opposite side of the base layer, the first part having an exposed surface for receiving a lubricant and for engagement with a shoe, and the second part having a grooved outer surface for promoting dewatering, wherein both said base layer and said resin layer are made from a heat-resistant material, said resin layer comprises a resin material containing filler to control its thermal conductivity, the filler in the first part of the resin layer has a thermal conductivity lower than that of the resin material, and the filler in the second part of the resin layer has a thermal conductivity higher than that of the resin material.

* * * * *